US005179064A

United States Patent [19]

Yonese et al.

[11] Patent Number: 5,179,064

[45] Date of Patent: Jan. 12, 1993

[54] HEAT-SENSITIVE RECORDING MATERIAL

[75] Inventors: Naoki Yonese; Masato Nakamura, both of Amagasaki, Japan

[73] Assignee: Kanzaki Paper Mfg. Co., Ltd., Tokyo, Japan

[21] Appl. No.: 691,541

[22] Filed: Apr. 25, 1991

[30] Foreign Application Priority Data

Apr. 28, 1990 [JP] Japan ..... 2-112065

[51] Int. Cl.[5] ..... B41M 5/40

[52] U.S. Cl. ..... 503/200; 427/152; 428/537.5; 503/226

[58] Field of Search ..... 503/200, 226, 207; 428/537.5, 211, 535; 427/150–152

[56] References Cited

U.S. PATENT DOCUMENTS 4,466,007 8/1984 Nakamura et al. ..... 503/200

*Primary Examiner*—Pamela R. Schwartz

*Attorney, Agent, or Firm*—Flynn, Thiel, Boutell & Tanis

[57] ABSTRACT

A heat-sensitive recording material which has a high recording density, ensures recorded images of high quality and allows printing on the reverse side. A base paper for the recording material is subjected to multilayer paper making by means of a paper machine having a multilayer head box. The surface layer of the base paper has a bulk density of below 0.85 g/cu. cm and a printing smoothness of above 15% (pressure: 20 kg/sq. cm) as measured by means of a printing smoothness tester.

16 Claims, No Drawings

HEAT-SENSITIVE RECORDING MATERIAL

BACKGROUND OF THE INVENTION (a) Field of the Invention

The present invention relates to a heat-sensitive recording material. More particularly, the invention relates to a heat-sensitive recording material having a high recording density and ensuring recorded images of high quality, said heat-sensitive recording material further having a multilayer construction which is free from layer splitting even when the reverse side is printed.

(b) Description of the Prior Art

Heat-sensitive recording materials are already well known. They are adapted to have a color image by applying a chromogenic material and a color developer in a mixed state to the surface of a base paper, said color image being produced by bringing the chromogenic material and the color developer into contact with each other by heat. Since such recording materials are relatively low-priced, they are used in increasing amounts as a recording medium for recording apparatuses such as facsimile machines and computers which have recently come into wide use.

With an increase in speed of said recording apparatuses, people demand heat-sensitive recording materials having an excellent dynamic recording sensitivity. With the diversification of use, there is an increasing demand for heat-sensitive recording materials ensuring recorded images of high quality in areas ranging from low density to high density.

Means tried so far to meet the above-mentioned demands may be summarized in the following three.

Means (1)

In this means, importance has been attached to the improvements of materials such as chromogenic materials, color developers and heat soluble materials (sensitivity increasing agents) forming a recording layer. For example, an attempt has been made to increase the recording sensitivity enough to respond even to minute heat energy by reducing the melting point of said heat soluble materials. In this case, the recording sensitivity is improved, but there are counterbalancing disadvantages that the appearance is ruined by texture stains appearing on the surface of the recording layer before recording and further recorded images are not clear, the unclear recorded images being a new defect. Therefore, this means has not necessarily brought about satisfactory results.

Means (2)

This means (disclosed by Japanese Patent Laid-Open Publication No. Sho 54-115255) is to increase the recording sensitivity by improving the smoothness of the base paper and at the same time obtain high image quality. In this means, the base paper is smoothed by strongly calendering it mainly on an off-machine super calender. This means has its limitations both in quality and in operation. Furthermore, smoothing the base paper spoils its heat insulating effect and results in inferior sensitivity.

Means (3)

With a view to improving the base paper, the base paper is made of three or more layers, whereby the compression elasticity thereof is increased, recording density is improved and curling is prevented (Japanese Patent Laid-Open Publication No. Sho 61-237689). In this means, two or more head boxes are used in paper making in order to obtain a recording material having a high recording sensitivity. However, in multilayer paper making by means of a cylinder paper machine and a Fourdrinier paper machine, it is particularly difficult to achieve said object because of the following problems: In general, a base paper for a heat-sensitive recording material is required to have a light basis weight of below 50 g/sq. m. If a base paper having such a light basis weight is to be obtained by multilayer paper making by means of a plurality of paper machines, each of the paper machines is required to make a paper having a basis weight of below about 25 g/sq. m. A paper having such a light basis weight is liable to break on the paper machine because the paper strength thereof is necessarily insufficient, and furthermore, paper making speed is low. As a result, it is difficult to industrially obtain a base paper having said light basis weight for a heat-sensitive recording material. Also, a base paper obtained by multilayer paper making by means of a plurality of paper machines has the disadvantage that the layer bond strength is weak. This disadvantage gives rise to a new problem that layer splitting is caused by ink picking at the time of printing on the reverse side for the enhancement of the product image.

SUMMARY OF THE INVENTION

It is a general object of the present invention to provide a novel heat-sensitive recording material which has obviated all the disadvantages of the prior art.

It is a more specific object of the present invention to provide a heat-sensitive recording material which gives recorded images of high quality in areas ranging from low density to high density.

It is another specific object of the present invention to provide a heat-sensitive recording material which gives recorded images of high quality and high density. This object is achieved, without strongly calendering a base paper itself, by improving the base paper in a heat-sensitive recording material provided on said base paper with a heat-sensitive recording layer which can form images by heat. Also included in this object is to provide a heat-sensitive recording material having a high sensitivity without any mixing of special materials which are a chromogenic material, color developer, etc.

It is a further object of the present invention to provide a heat-sensitive recording material having a layer bond strength which is strong enough to prevent layer splitting caused by ink picking during printing on the reverse side for the enhancement of the product image.

To achieve the above-mentioned objects of the present invention, a base paper is adapted to have two or more layers by means of a paper machine having one multilayer head box, the bulk density (by JIS P-8118) of said base paper being 0.85 g/cu. cm, the printing smoothness of the surface layer of said base paper being above 15% (pressure: 20 kg/sq. cm).

The multilayer paper process in the present invention employs one multilayer head box having two or more slice layers. In the multilayer paper process, it is possible to dispose a material of a specific composition on the surface layer of a base paper and further to freely make a base paper having a relatively light basis weight. By using the multilayer head box in paper making, it is possible to apply a material having a low bulk density to an intermediate layer or back layer of the base paper, and therefore, it is also possible to control cushioning and heat insulation which the base paper of a heat-sensitive recording material is required to have. A base paper adapted to have two or more layers by means of a paper machine having a multilayer head box has a strong layer bond strength and is unlikely to cause troubles such as layer splitting as compared with a base paper made by means of a paper machine having a plurality of head boxes. This is because the intertwining of fibers between layers in simultaneous paper making by means of a multilayer head box is much stronger than that in conventional non-simultaneous paper making by means of a plurality of head boxes.

Since the present invention makes it possible to join different kinds of materials by the multilayer paper making, it is possible to make very smooth only the surface layer of a base paper having a low bulk density. This ensures a high recording sensitivity and recorded images of high quality, and makes it possible to obtain an excellent base paper for a heat-sensitive recording material which is free from layer splitting even when the reverse side is printed.

In the present invention, it is necessary to make the surface of the base paper very smooth to such an extent that the surface layer of the base paper has a printing smoothness of above 15% (pressure: 20 kg/sq. cm) as measured by means of a printing smoothness tester.

The printing smoothness tester is a device for measuring the smoothness of a paper by pressing the paper against the surface of glass under certain pressure conditions. Unlike a Bekk smoothness tester and a Parker print-surf which are smoothness testers of a general air leakage type, the printing smoothness tester is not affected by the air permeability of the paper and shows values which relatively faithfully represent actual smoothness. Therefore, on the basis of a value given by the printing smoothness tester, (pressure: 20 kg/sq. cm) it is possible to judge relatively accurately whether a desired result has been obtained.

If the surface of the base paper has a printing smoothness of below 15% as measured by means of the printing smoothness tester (pressure: 20 kg/sq. cm), the contact between the recording material and the recording head is uneven and the density and quality of recorded images are reduced. Therefore, the desired results of the present invention cannot be obtained.

In smoothing the surface of the base paper, it is possible to use a machine calender having only metal rolls, said machine calender being usually disposed at the rearmost part of a Fourdrinier paper machine or a cylinder paper machine. Alternatively, it is also possible to use, on machine or off machine (In this specification, "on machine" means "on the paper machine", and "off machine" means "off the paper machine."), a super calender, a gloss calender, a soft calender, etc. which have both metal rolls and elastic rolls.

Metal rolls may be any of the following: chilled rolls, alloy chilled rolls, steel rolls, and metal rolls plated with hard chrome. Elastic rolls may be made of any of the following materials: natural rubber, styrene rubber, nitrile rubber, chloroprene rubber, chlorosulfonic ethylene rubber, butyl rubber, rubber polysulfide, silicone rubber, rubber fluoride, urethan rubber; plastic resins such as aromatic polyamide resin, polyimide resin, polyether resin, polyester resin and polycarbonate resin; cotton, paper, wool, tetrone, nylon and mixtures thereof.

In view of efficiency it is desirable to smooth the surface of the base paper on machine, preferably by means of a soft calender which comprises elastic rolls having a Shore-D hardness (ASTM Standard, D-2240) of 42 to 98 deg. The elastic rolls of the soft calender are preferably made of urethan rubber, aromatic polyamide resin, a mixture of paper and wool, a mixture of wool and tetrone, a mixture of wool and nylon, a mixture of paper, wool and tetrone, or a mixture of paper, wool and nylon. Particularly, elastic rolls made of urethane rubber, aromatic polyamide resin or a mixture of paper and wool are more preferably used because they are easy to handle, have a long life and help to obtain the desired results of the present invention.

It is also possible to smooth the surface of the base paper by using, as a dryer for the paper machine, a Yankee dryer which has a specular surface of hard chrome plating, etc. In any case, it is necessary that the surface of the base paper has a printing smoothness of above 15% as measured by means of a printing smoothness tester (pressure: 20 kg/sq. cm).

The surface layer of a base paper on which a recording layer is to be disposed is preferably made of mainly hardwood pulp having short fibers which contribute to smoothness. The intermediate layer and back layer of the base paper are preferably made of kenaf having long fibers or softwood pulp. Also, bulky pulps such as a ground pulp (GP), bleached chemithermomechanical pulp (BCTMP) and old newsprint containing mechanical pulp are preferably used because these pulps make it easy to form a layer having a low bulk density and ensure sufficient heat insulation.

In the present invention, it is desirable to select one or more inorganic pigments having an oil absorption of above 30 ml/100 g out of fillers shown below by way of example, add the selected inorganic pigments to the surface layer of the base paper in an amount of above 15% by weight of the total weight of said surface layer, and smooth the surface layer of the base paper by means of said super calender or machine calender.

In the conventional multilayer paper making by means of a plurality of head boxes, if the surface layer contains much filler, paper will frequently break on the paper machine because the paper strength thereof is insufficient and the production efficiency will be reduced. In multilayer paper making by means of a multilayer head box, according to the present invention, such a problem is unlikely to arise and smoothness which a base paper for a heat-sensitive recording material should have is easily obtained.

Fillers may be any of the following for example: kaolin, calcined kaolin, silica, clay, talc, precipitated calcium carbonate, magnesium carbonate, magnesium oxide, aluminum oxide, titanium oxide, diatomaceous earth, activated clay, etc. Usable fillers are not limited to the above and two or more of them may be used.

The bulk density of the base paper is a condition for ensuring that heat energy from a thermal head remains only on the surface of the base paper and is not transmitted to the inside of the base paper. In this respect, it is necessary to control the bulk density of the base paper below 0.85 g/cu. cm. To obtain a layer having such a low bulk density, it is possible to adopt any of the following means: reducing the beating degree of pulps for the intermediate layer or the back layer of the base paper, using a paper stuff containing a small amount of ash, or using kenaf, soft wood pulp or bulky pulp.

In the heat-sensitive recording material of the present invention, as mentioned above, the base paper is prepared by said multilayer paper making by means of a multilayer head box, the bulk density of the base paper being below 0.85 g/cu. cm, the printing smoothness thereof being above 15% (pressure: 20 kg/sq. cm). If an undercoating layer comprising one or more pigments having an oil absorption (by a method under JIS K-5101) of above 80 ml/100 g is provided between said base paper and a heat-sensitive layer, then the effect of the present invention will be much improved.

Pigments having an oil absorption of above 80 ml/100 g may be, for example, calcined clay, aluminum oxide, titanium oxide, magnesium carbonate, diatomaceous earth, amorphous silica, aluminum silicate, magnesium silicate, calcium silicate, soda aluminosilicate, magnesium aluminosilicate, etc., or inorganic or organic pigments obtained by physically or chemically treating general pigments so as to have said specific oil absorption. Among these pigments, calcined clay and amorphous silica are the most preferably used because they have excellent heat insulation and improve recording sensitivity very much. Binders used with said pigments include water-soluble high polymers such as starch, casein, polyvinyl alcohol, methylcellulose, carboxymethylcellulose, hydroxyethylcellulose and polyacrylic acid; and synthetic resin emulsions such as styrene-butadiene copolymer, styrene-acrylic acid copolymer, acrylonitrile-butadiene copolymer, styrene-acrylic ester copolymer containing colloidal silica, and acrylic acid copolymer.

The undercoating layer may contain various additives as follows: dispersing agents such as sodium dioctylsulfosuccinate, sodium dodecylbenzenesulfonate, sodium salt of lauryl alcohol sulfate and metal salts of fatty acids; antifoaming agents; fluorescent dyes; and coloring dyes.

Such a coating composition for the undercoating layer is applied to the base paper by means of a coater so that the coating amount is 3 to 20 g/sq. m, and then the coating composition is dried.

A heat-sensitive recording layer is formed by a conventional method on the surface of the base paper or the undercoating layer thus obtained. Color forming materials forming the recording layer may be any of various combinations for example as follows:

(a) Combination of a compound having a secondary alcoholic hydroxyl group and a melting point of 100 to 180 deg. C.; sulfur; and metallic inorganic salt or acetate of metal Said compound having a secondary alcoholic hydroxyl may be any of the following: benzoin compounds such as benzoin, 2-methoxybenzoin, 4-chlorobenzoin, 4-dimethylaminobenzoin and 2-chloro-4-dimethlaminobenzoin; carbinols such as diphenylcarbinol; phenolic compounds such as resorcine, pyrogallic acid, 3-hydroxytoluene-4-sulfoacid, 4-nitroresorcine and 4,6-dibromresorcine; fatty acid polyhydric alcohols such as erythrite, sorbite, galactose, maltose, mannite and saccharose. Said metallic inorganic salt or acetate of metal may be any of the following metals which produce colored sulfide by acting upon hydrogen sulfide: copper, lead, tin, molybdenum, cobalt, chrome, nickel, manganese, titanium, antimony, rhodium, osumium, mercury, iron, barium, bismuth, arsenic, magnesium, indium, iridium, etc.

(b) The same combination as (a) above except that said metallic inorganic salt is replaced by hexamethylenetetramine-metallic salt additive.

(c) Combination of carbohydrate and dehydrating agent

Said carbohydrate may be any of saccharose, fructose, galactose, starch, etc. Said dehydrating agent may be any of sulfuric acid, acetic anhydride, zinc chloride anhydride, paratoluene sulfonic acid, etc.

(d) Combination of ferric salts of higher fatty acids such as ferric stearate and ferric myristate; and phenoles such as tannic acid, gallic acid and ammonium salicylate.

(e) Combination of heavy metal salts (nickel, cobalt, lead, copper, iron, mercury, silver, etc.) of carboxylic acids (acetic acid, stearic acid, palmitic acid, etc.); and alkaline earth metal sulfides such as calcium sulfide, strontium sulfide and barium sulfide; or combination of said heavy metal salts of carboxylic acids; and organic chelating agents such as S-diphenyylcarbazide and diphenylcarbazon.

(f) Combination of heavy metal salts of oxalic acid (silver, lead, mercury, thorium, etc.); and sulfur compounds such as sodium tetrathionate, sodium thiosulfate and thiourea.

(g) Combination of ferric salts of fatty acids such as ferric stearate; and polyhydroxy aromatic compounds such as 3,4-dehydroxy tetraphenylmethane.

(h) Combination of noble metal salts such as silver oxalate and mercury oxalate; and organo-polyhydroxy compounds such as polyhydroxy alcohols, glycerols and glycols.

(i) Combination of noble metal salts such as silver behenate and silver stearate; and aromatic reducing agents such as protocatechuic acid, spiro-indane and hydroquinone.

(j) Combination of ferric salts of fatty acids such as ferric pelargonate and ferric laurate; and thiosemicarbazide derivatives or isothiosemicarbazide derivatives.

(k) Combination of lead salts of organic acids such as lead capronate, lead pelargonate and lead behenate; and thiourea derivatives such as ethylenethiourea and N-dodecylthiourea.

(l) Combination of heavy metal salts of higher fatty acids such as ferric stearate and copper stearate; and lead salt of dialkyldithiocarbanic acid.

(m) Oxazine dye formed by the use of resorcinol in combination with nitroso-compounds.

(n) Azo dye formed by the use of diazonium compounds in combination with coupling agents.

(o) Combination of colorless or light color basic dyes such as crystal violet lactone; and color developers such as bisphenol A.

Among the above-mentioned various combinations, the combination of basic dye and color developer is the most preferably used and is described in detail below.

Various basic dyes as follows are already known: triallymethane compounds such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide and 3-p-dimethylaminophenyl-3-(1-methylpyrrole-3-yl)-6-dimethylaminophthalide; diphenylmethane compounds such as 4,4-bis-dimethylaminobenzhydryl benzyl ether, N-halophenylleucoauramine and N-2,4,5-trichlorophenyl-leucoauramine; thiazine compounds such as benzoylleucomethylene blue and p-nitrobenzoyl-leucomethylene blue; spiro compounds such as 3-methyl-spiro-dinaphtholpyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran and 3-propyl-spiro-dibenzopyran; lactam compounds such as Rhodamine-B-anilinolactam, Rhodamine(p-nitroanilino)lactam and Rhodamine(o-chloroanilino)-lactam; and fluoran compounds such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methy-7-phenylaminofluoran, 3-diethylamino-7-(2-carbomethoxy-phenylamino)fluoran, 3-(N-cyclohexyl-N-methylamino)-6-methyl-7-phenylaminofluoran, 3-pyrrolidino-6-methyl-7-phenylamino-fluoran, 3-piperidino-6-methy-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-diethylamino-7-(o-fluorophenylamino)fluoran, 3-dibutylamino-7-(o-fluorophenylamino)fluoran, 3-dibutylamino-6-methyl-7-phenylaminofluoran, 3-(N-methyl-N-n-amyl)amino-6-methyl-7-phenylaminofluoran, 3-(N-ethyl-N-n-amyl-)amino-6-methyl-7-phenylaminofluoran, 3-(N-ethyl-N-iso-amyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-β-ethylhexyl-)amino-6-methyl-7-phenylaminofluoran, 3-(N-ethyl-N-tetrahydrofurfuryl)amino-6-methyl-7-phenylaminofluoran, and 3-(N-ethyl-N-cyclopentyl)amino-6-methyl-7-phenylaminofluoran. The basic dye used in the present invention is not limited to the above. It is also possible to use two or more of said dyes.

Color developers used with said basic dyes may be, for example, any of the following organic acidic compounds already known: phenolic compounds such as 4-tert-butylphenol, ∂-naphthol, β-naphthol, 4-acetylphenol, 4-tert-octylphenol, 4,4'-sec-butylidenediphenol, 4-phenylphenol, 4,4'-dihydroxy-diphenylmethane, 4,4'-isopropylidenediphenol, hydroquinone, 4,4'-cyclohexylidenediphenol, 4,4'-(1,3-dimethylbutylidene)bisphenol, 2,2-bis(4-hydroxyphenyl)-4-methyl-pentane, 4,4'-dihydroxyphenylsulfide, 4,4'-thiobis(6-tert-butyl-3-methylphenol), 4,4'-dihydroxydiphenylsulfone, 4-hydroxy-4'-methyldiphenylsulfone, 4-hydroxy-4'-methoxydiphenylsulfone, 4-hydroxy-4'-isopropoxydiphenylsulfone, 4-hydroxy-3',4'-trimethylenediphenylsulfone, 4-hydroxy-3'4'-tetramethylenediphenylsulfone, 3,4-dihydroxy-4'-methyldiphenylsulfone, bis(3-aryl-4-hydroxyphenyl)sulfone, 1,3-di[2-(4-hydroxyphenyl)-2-propyl]benzene, hydroquinone monobenzyl ether, bis(4-hydroxyphenyl)acetic acid butyl ester, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resin and phenol polymers; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3,5-di-tert-butylsalicylic acid, 3-benzylsalicylic acid, 3-(∂-methylbenzyl)salicylic acid, 3-chloro-5-(∂-methylbenzyl)salicylic acid, 3-phenyl-5-(∂,∂-dimethylbenzyl)salicylic acid and 3,5-di-∂-methylbenzylsalicylic acid; and salts of said phenolic compounds or aromatic carboxylic acids and polyvalent metals such as zinc, magnesium, aluminum, calcium, titanium, manganese, tin and nickel.

The ratio of the basic dye and color developer to be used varies according to the kinds of the basic dye and color developer. The color developer is used generally in a range of 100 to 700 parts by weight, preferably 150 to 400 parts by weight, per 100 parts by weight of the basic dye.

A coating composition containing said basic dye and color developer is prepared generally by dispersing the basic dye and color developer together or separately in water by means of a mixer or pulverizer such as a ball mill, attritor and sand mill.

The coating composition contains a binder in an amount of 2 to 40% by weight, preferably 5 to 25% by weight, of the total solid matters, said binder being for example any of the following: starches, hydroxyethylcellulose, methylcellulose, carboxymethylcellulose, gelatin, casein, arabic gum, polyvinyl alcohol, salts of styrene-maleic anhydride copolymer, salts of styrene-acrylic acid copolymer, styrene-butadiene copolymer emulsion, etc.

The coating composition may further contain various additives as follows: dispersing agents such as sodium dioctylsulfosuccinate, sodium dodecylbenzenesulfonate, sodium salt of lauryl alcohol sulfate and metal salts of fatty acids; antifoaming agents; fluorescent dyes and coloring dyes.

To decrease smudges on the recording head, the coating composition may contain inorganic pigments such as kaolin, clay, talc, calcium carbonate, calcined clay, titanium oxide, diatomaceous earth, finely divided silicic anhydride and activated clay. To prevent the heat-sensitive recording material from sticking to the recording apparatus or recording head, the coating composition may further contain a dispersion or emulsion of stearic acid, polyethylene, carnabauba wax, paraffin wax, zinc stearate, calcium stearate and ester wax.

Various known matters melted by heat may be used as sensitizers to such an extent that they do not ruin the desired effects of the present invention. The sensitizers may be any of the following: caproic acid amide, capric acid amide, stearic acid amide, oleic acid amide, erucic acid amide, linolic acid amide, linoleic acid amide, N-ethylcapric acid amide, N-butyllaulic acid amide, N-octadecyl acetamide, N-olein acetamide, N-oleyl benzolamide, N-stearyl cyclohexylamide, polyethyleneglycol, 1-benzyloxynaphthalene, 2-benzyloxynaphthalene, phenyl 1-hydroxynaphthoate, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophenoxy)ethane, 1-phenoxy-2-(4-methoxyphenoxy)ethane, 1-(2-methylphenoxy)-2-(4-methoxyphenoxy)ethane, dibenzyl telephthalate, dibenzyl oxalate, di(4-methylbenzyl)oxalate, benzyl p-benzyloxybenzoate, p-benzylbiphenyl, 1,5-bis(p-methoxyphenoxy)-3-oxapentane, 1,4-bis(2-vinyloxyethoxy)benzene, p-biphenyl-p-tollyl ether, benzyl-p-methylthiophenyl ether, 2-(2'-hydroxy-5'-methylphenyl)benzotriasol and 2-hydroxy-4-benzyloxybenzophenone.

Among the above-mentioned sensitizers, 1,2-diphenoxyethane, 1,2-bis(3-methylphenoxy)ethane, 1-(2-methylphenoxy)-2-(4-methoxyphenoxy)ethane, dibenzyl oxalate and di(4-methylbenzyl)oxalate are preferably used because they ensure a heat-sensitive recording material which has excellent whiteness, image stability and recording density.

A recording layer may be formed by any means including conventional prior art. For example, a coating composition for the heat-sensitive recording layer may be applied to the base paper by means of any of conventional coaters such as an air knife coater, blade coater, bar coater, gravure coater and curtain coater.

While the amount of the coating composition to be used is not limited, it is generally adjusted to 2 to 12 g/sq. m, preferably 3 to 10 g/sq. m, on a dry basis.

It is possible to provide an overcoating layer on top of the recording layer for the protection, etc. of the recording layer. Furthermore, various prior art in the field of production of heat-sensitive recording materials may be applied. For example, the reverse side of the base paper may be provided with a protective layer or an adhesive means.

The heat-sensitive recording material of the present invention having said base paper has a high recording density and ensures recorded images of high quality. Also, the heat-sensitive recording material allows printing on the reverse side.

DESCRIPTION OF EXAMPLES

The present invention will now be described in detail with reference to examples. It is to be understood that the present invention is not limited to the examples. In the examples, "parts" or "%" (percent) means "parts" or "%" by weight, unless otherwise stated.

EXAMPLES 1 TO 6

Preparation Of Base Papers

In Examples 1 to 5, base papers each having two layers were made from paper stuffs for respective examples shown in Table 1 by a multilayer paper making method by means of a multilayer head box.

Each of said base papers in Examples 1 to 5 was subjected to multilayer paper making so that the surface layer had a basis weight of 10 g/sq. m and the back layer had a basis weight of 30 g/sq. m, then each of said base papers being calendered. Each of said base papers for heat-sensitive recording materials thus obtained had a total basis weight of 40 g/sq. m, a bulk density of below 0.85 g/cu. cm and a printing smoothness on the surface layer of above 15% (pressure: 20 kg/sq. cm).

The bulk density and the printing smoothness on the surface layer of each of said base papers in Examples 1 to 5 are shown in Table 1.

In Example 6, a base paper having three layers was made by the above-mentioned multilayer paper making method by means of a multilayer head box.

Said base paper in Example 6 was subjected to multilayer paper making so that the surface layer had a basis weight of 10 g/sq. m, the intermediate layer having a basis weight of 20 g/sq. m, and the back layer having a basis weight of 10 g/sq. m, then said base paper being calendered. Said base paper for a heat-sensitive recording material thus obtained had a total basis weight of 40 g/sq. m, a bulk density of 0.69 g/cu. cm and a printing smoothness on the surface layer of 21%.

Preparation Of A Coating Composition For A Recording Layer (1) Preparing composition "A"

10 parts: 3-(N-cyclohexyl-N-methylamino)-6-methyl-7-phenylaminofluoran
15 parts: 1,2-bis-(3-mehtylphenoxy)-ethane
15 parts: 5% aqueous solution of methyl cellulose
80 parts: water This composition was pulverized by means of a sand mill so that the mean particle size was 1 μm.

(2) Preparing composition "B"

30 parts: 4,4'-isopropylidenediphenol
30 parts: 5% aqueous solution of methyl cellulose
70 parts: water This composition was pulverized by means of a sand mill so that the mean particle size was 2 μm.

(3) Preparing a coating composition for heat-sensitive recording materials 120 parts: composition "A"
130 parts: composition "B"
30 parts: amorphous silica
150 parts: 20% aqueous solution of oxidized starch.
55 parts: water A coating composition for heat-sensitive recording materials was prepared by mixing and agitating the above.

Preparation Of Heat-sensitive Recording Materials

The coating composition thus obtained was applied onto each base paper shown in Table 1 so that the coating weight after drying was 7 g/sq. m, each of said base paper being dried and calendered by means of a super calender. Thus, heat-sensitive recording materials for Examples 1 to 6 were obtained.

EXAMPLE 7

An undercoating layer was prepared by applying a coating composition therefor shown below to said base paper for a heat-sensitive recording material in Example 1 by means of a bar coater so that the coating weight after drying was 8 g/sq. m.

The coating composition for the undercoating layer consists of the following:

100 parts: calcined clay (trade mark "ANSILEX", made by Engelhard Minerals & Chemicals Corporation, U.S.A., oil absorption of 110 cc/g)
15 parts: styrene-butadiene copolymer latex (trade mark "L-1571", made by Asahi-Kasei Co., Ltd., Japan, solid amount of 48%)
20 parts: 15% aqueous solution of polyvinyl alcohol
180 parts: water A heat-sensitive recording material was obtained by applying the same coating composition for the heat-sensitive recording layer as in Example 1 on the undercoating layer obtained above in the same way as in Example 1.

EXAMPLE 8

A base paper for a heat-sensitive recording material having a total basis weight of 40 g/sq. m, a bulk density of 0.72 g/cu. cm and a printing smoothness on the surface layer of 19% (pressure: 20 kg/sq. cm) was obtained in the same way as in Example 5 except that the pulp slurry for the back layer consisted of old newsprint (50%) and softwood (nadel-holz) bleached kraft pulp (NBKP) (50%) in place of bleached chemithermomechanical pulp (50%) and softwood (nadel-holz) bleached kraft pulp (50%). A heat-sensitive recording material was obtained in the same way as in Example 1 except that said base paper was used.

EXAMPLE 9

A base paper for a heat-sensitive recording material having a total basis weight of 40 g/sq. m, a bulk density of 0.70 g/cu. cm and a printing smoothness on the surface layer of 20% (pressure: 20 kg/sq. cm) was obtained in the same way as in Example 6 except that the pulp slurry for the intermediate layer consisted of old newsprint (100%) in place of ground pulp (100%). A heat-sensitive recording material was obtained in the same way as in Example 1 except that said base paper was used.

COMPARATIVE EXAMPLE 1

Preparation Of A Base Paper

In Comparative Example 1, a base paper having two layers was made from paper stuffs shown in Table 1 by a multilayer paper making method by means of a multilayer head box.

Said base paper was subjected to multilayer paper making so that the surface layer had a basis weight of 10 g/sq. m and the back layer had a basis weight of 30 g/sq. m, then said base paper being calendered. Said base paper for a heat-sensitive recording material thus obtained had a total basis weight of 40 g/sq. m, a bulk density of 0.83 g/cu. cm and a printing smoothness on the surface layer of 13% (pressure: 20 kg/sq. cm). A heat-sensitive recording material was obtained in the same way as in Example 1 except that said base paper was used.

COMPARATIVE EXAMPLE 2

The base paper used in Comparative Example 1 was calendered by means of a super calender so that the printing smoothness on the surface layer was 17% (pressure: 20 kg/sq. cm). At this time, the base paper had a bulk density of 0.88 g/cu. cm. A heat-sensitive recording material was obtained in the same way as in Example 1 except that said base paper was used.

COMPARATIVE EXAMPLE 3

A base paper for a heat-sensitive recording material was obtained by making a paper stuff used for the surface layer in Example 1 into a paper having a basis weight of 40 g/sq. m, said paper being treated in the same way as in Example 1. A heat-sensitive recording material was obtained in the same way as in Example 1 except that said base paper was used. Said base paper had a bulk density of 0.87 g/cu. cm and a printing smoothness of 18% (pressure: 20 kg/sq. cm).

COMPARATIVE EXAMPLE 4

A base paper for a heat-sensitive recording material was obtained by making a paper stuff used for the back layer in Example 3 into a paper having a basis weight of 40 g/sq. m, said paper being treated in the same way as in Example 1. A heat-sensitive recording material was obtained in the same way as in Example 1 except that said base paper was used. Said base paper had a bulk density of 0.80 g/cu. cm and a printing smoothness of 11% (pressure: 20 kg/sq. cm).

COMPARATIVE EXAMPLE 5

A base paper was made from paper stuffs shown in Table 1, Comparative Example 5, by multilayer (two-layer) paper making by means of a cylinder paper machine and two head boxes so that both the surface layer and the back layer had a basis weight of 22 g/sq. m. Then, the base paper was calendered to obtain a base paper for a heat-sensitive recording material having a total basis weight of 44 g/sq. m, a bulk density of 0.87 g/cu. cm and a printing smoothness on the surface layer of 12% (pressure: 20 kg/sq. cm). A heat-sensitive recording material was obtained in the same way as in Example 1 except that said base paper was used.

The 14 kinds of heat-sensitive recording materials thus obtained were recorded by means of an "OHKURA" simulator (applied voltage 13 v, pulse interval 0.51 ms) at a pulse length of 0.45 ms, and the image densities thereof were measured by means of a "Macbeth" densitometer. The results of the measurements are shown in Table 2.

The quality of recorded images were visually measured. The results of the visual measurements are represented in Table 2 by the following four relative valuations:

◎: Very good
○: Good
Δ: Poor
X: Very poor

Each of the base papers in the Examples 1 to 9 and Comparative Examples 1 to 5 was printed on the back layer by means of an "RI" printing tester, and layer splitting tests were made.

Ink used: "SD Super Deluxe 50 Red"
Amount of ink used: 0.4 cc

The results of the layer splitting tests are represented in Table 2 by the following three relative valuations:

○: Almost no layer splitting. No problem.
Δ: Some layer splitting. No problem in practice.
X: Strong layer splitting. There are problems in practice.

TABLE 1

| Layers | Pulp composition | Freeness (cc) | Fillers % on pulp | Size % on pulp | Bulk density g/cu · cm | Printing smoothness (%) |
|---|---|---|---|---|---|---|
| Examples | | | | | | |

TABLE 1-continued

| | Layers | Pulp composition | | Freeness (cc) | Fillers % on pulp | | Size % on pulp | Bulk density g/cu · cm | Printing smoothness (%) |
|---|---|---|---|---|---|---|---|---|---|
| 1 | SL | LBKP | 100% | 430 | talc | 18% | rosin 1.4% | 0.72 | 22 |
| | BL | BCTMP | 100% | 480 | talc | 5% | rosin 0.5% | | |
| 2 | SL | LBKP | 100% | 430 | talc | 25% | rosin 1.4% | 0.83 | 25 |
| | BL | BCTMP | 100% | 480 | talc | 5% | rosin 0.5% | | |
| 3 | SL | LBKP | 100% | 430 | talc | 18% | rosin 1.4% | 0.73 | 23 |
| | BL | GP | 100% | 490 | talc | 5% | rosin 0.5% | | |
| 4 | SL | LBKP | 100% | 430 | kaolin | 13% | rosin 1.4% | 0.75 | 17 |
| | BL | GP/NBKP (50%/50%) | | 475 | talc | 5% | rosin 0.5% | | |
| 5 | SL | LBKP | 100% | 430 | talc | 18% | rosin 1.4% | 0.73 | 20 |
| | BL | BCTMP/NBKP (50%/50%) | | 485 | talc | 5% | rosin 0.5% | | |
| 6 | SL | LBKP | 100% | 430 | talc | 18% | rosin 1.4% | 0.69 | 21 |
| | IL | GP | 100% | 490 | talc | 5% | rosin 0.5% | | |
| | BL | BCTMP | 100% | 480 | talc | 5% | rosin 0.5% | | |
| 7 | * | — | | — | — | | — | — | — |
| 8 | SL | LBKP | 100% | 430 | talc | 18% | rosin 1.4% | 0.72 | 19 |
| | BL | ONP/NBKP (50%/50%) | | 390 | talc | 5% | rosin 0.5% | | |
| 9 | SL | LBKP | 100% | 430 | talc | 18% | rosin 1.4% | 0.70 | 20 |
| | IN | ONP | 100% | 250 | talc | 5% | rosin 0.5% | | |
| | BL | BCTMP | 100% | 480 | talc | 5% | rosin 0.5% | | |
| Comparative Examples | | | | | | | | | |
| 1 | SL | LBKP | 100% | 430 | talc | 10% | rosin 1.0% | 0.83 | 13 |
| | BL | NBKP | 100% | 480 | talc | 5% | rosin 0.5% | | |
| 2 | ** | — | | — | — | | — | 0.88 | 17 |
| 3 | single | LBKP | 100% | 430 | talc | 18% | rosin 1.4% | 0.87 | 18 |
| 4 | single | GP | 100% | 490 | talc | 5% | rosin 0.5% | 0.80 | 11 |
| 5 | SL | LBKP | 100% | 430 | talc | 5% | rosin 1.0% | 0.87 | 12 |
| | BL (CPM) | NBKP | 100% | 480 | talc | 5% | rosin 0.5% | | |

Notes to Table 1:
SL: surface layer
BL: back layer
IL: intermediate layer
ONP: old newsprint
*Example 1 plus undercoating layer
**Comparative Example 1 plus super calender
CPM: cylinder paper machine

TABLE 2

| | Recording density | Quality of recorded image | Layer splitting by RI tester |
|---|---|---|---|
| Examples | | | |
| 1 | 1.18 | ○ | ○ |
| 2 | 1.14 | ○ | ○ |
| 3 | 1.16 | ○ | ○ |
| 4 | 1.09 | ○ | ○ |
| 5 | 1.17 | ○ | ○ |
| 6 | 1.15 | ○ | Δ |
| 7 | 1.46 | ◎ | ○ |
| 8 | 1.15 | ○ | ○ |
| 9 | 1.14 | ○ | Δ |
| Comparative Examples | | | |
| 1 | 1.00 | Δ | ○ |
| 2 | 0.98 | ○ | ○ |
| 3 | 0.88 | X | ○ |
| 4 | 0.70 | X | ○ |
| 5 | 1.01 | Δ | X |

We claim:

1. A heat-sensitive recording material comprising a base paper with a heat-sensitive recording layer which can form images by heat, the improvements comprising said base paper being made by means of a paper machine having a multi-layer head box so as to have two or more layers, said base paper having a bulk density of below 0.85 g/cu. cm as measured by a method under JIS P-8118, a surface layer of said base paper on which said recording layer is applied having a printing smoothness of above 15% as measured under a pressure of 20 kg/sq. cm.

2. A heat-sensitive recording material as claimed in claim 1, wherein said surface layer contains one or more inorganic pigments in an amount of above 15% by weight of the total weight of said surface layer, said inorganic pigments having an oil absorption as measured by a method under JIS K-5101 of above 30 ml/100 g.

3. A heat-sensitive recording material as claimed in claim 2, wherein a back layer of said base paper, or an intermediate layer thereof between said surface layer and said back layer when said base paper has three or more layers, contains one or more pulps comprising a ground pulp, bleached chemithermomechanical pulp or old newsprint.

4. A heat-sensitive recording material as claimed in claim 3, wherein said surface layer contains one or more hardwood pulps.

5. A heat-sensitive recording material as claimed in claim 4, wherein an undercoating layer is applied between said base paper and said heat sensitive recording layer, said undercoating layer containing one or more pigments having an oil absorption as measured by said method under JIS K-5101 of above 80 ml/100 g.

6. A heat-sensitive recording material as claimed in claim 3, wherein an undercoating layer is applied between said base paper and said heat sensitive recording layer, said undercoating layer containing one or more pigments having an oil absorption as measured by said method under JIS K-5101 of above 80 ml/100 g.

7. A heat-sensitive recording material as claimed in claim 2, wherein said surface layer contains one or more hardwood pulps.

8. A heat-sensitive recording material as claimed in claim 7, wherein an undercoating layer is applied between said base paper and said heat sensitive recording layer, said undercoating layer containing one or more pigments having an oil absorption as measured by said method under JIS K-5101 of above 80 ml/100 g.

9. A heat-sensitive recording material as claimed in claim 2, wherein an undercoating layer is provided between said base paper and said heat-sensitive recording layer, said undercoating layer containing one or more pigments having an oil absorption as measured by said method under JIS K-5101 of above 80 ml/100 g.

10. A heat-sensitive recording material as claimed in claim 1, wherein a back layer of said base paper, or an intermediate layer thereof between said surface layer and said back layer when said base paper has three or more layers, contains one or more pulps comprising a ground pulp, bleached chemithermomechanical pulp or old newsprint.

11. A heat-sensitive recording material as claimed in claim 10, wherein said surface layer contains one or more hardwood pulps.

12. A heat-sensitive recording material as claimed in claim 11, wherein an undercoating layer is applied between said base paper and said heat sensitive recording layer, said undercoating layer containing one or more pigments having an oil absorption as measured by a method under JIS K-5101 of above 80 ml/100 g.

13. A heat-sensitive recording material as claimed in claim 10, wherein an undercoating layer is applied between said base paper and said heat sensitive recording layer, said undercoating layer containing one or more pigments having an oil absorption as measured by a method under JIS K-5101 of above 80 ml/100 g.

14. A heat-sensitive recording material as claimed in claim 1, wherein said surface layer contains one or more hardwood pulps.

15. A heat-sensitive recording material as claimed in claim 14, wherein an undercoating layer is applied between said base paper and said heat sensitive recording layer, said undercoating layer containing one or more pigments having an oil absorption as measured by a method under JIS K-5101 of above 80 ml/100 g.

16. A heat-sensitive recording material as claimed in claim 1, wherein an undercoating layer is provided between said base paper and said heat-sensitive recording layer, said undercoating layer containing one or more pigments having an oil absorption as measured by said method under JIS K-5101 of above 80 ml/100 g.

* * * * *